US005220868A

United States Patent [19]

Dunnam

[11] Patent Number: 5,220,868

[45] Date of Patent: Jun. 22, 1993

[54] PRINT BAND CLEANER

[75] Inventor: Glen A. Dunnam, Palm Bay, Fla.

[73] Assignee: Harris Corporation, Melbourne, Fla.

[21] Appl. No.: 791,853

[22] Filed: Nov. 14, 1991

[51] Int. Cl.[5] ..... B41F 35/00; B41L 41/00

[52] U.S. Cl. ..... 101/423; 101/424.1; 101/425; 15/77; 15/88.2; 134/157

[58] Field of Search ..... 101/423, 424, 424.1, 101/424.2, 425, 156, 168; 15/77, 88.2, 100, 102; 134/144, 151, 157, 9

[56] References Cited

U.S. PATENT DOCUMENTS

| | | | |
|---|---|---|---|
| 2,516,636 | 7/1950 | Marcy | 15/77 |
| 3,434,240 | 3/1969 | Phelps | 15/77 |
| 3,635,762 | 1/1972 | Ott et al. | 134/9 |
| 3,871,081 | 3/1975 | Inoue et al. | 15/256.51 |
| 4,211,580 | 7/1980 | Vowles | 15/100 |
| 4,474,445 | 10/1984 | Wilson | 15/77 |
| 4,672,985 | 6/1987 | Mohr | 134/144 |
| 4,704,963 | 11/1987 | Nishimura et al. | 101/423 |
| 4,918,778 | 4/1990 | Chupin et al. | 15/102 |
| 5,055,870 | 10/1991 | Ohba et al. | 15/77 |

FOREIGN PATENT DOCUMENTS

| | | | |
|---|---|---|---|
| 1244263 | 8/1971 | United Kingdom | 101/423 |

*Primary Examiner*—Edgar S. Burr
*Assistant Examiner*—Lynn D. Hendrickson
*Attorney, Agent, or Firm*—Evenson, Wands, Edwards, Lenahan & McKeown

[57] ABSTRACT

A cleaning apparatus and method for cleaning a print band utilizes a self-contained housing with pulleys arranged vertically or horizontally. One of the pulleys is motor driven at relatively low speed. A print band to be cleaned is installed around the pulleys in the housing and is urged toward a high-speed rotating brush by a spring-biased pressure plate. Air jets can be used downstream of the brush station to dry cleaning solution that remains on the print band.

18 Claims, 2 Drawing Sheets

PRINT BAND CLEANER

FIELD OF THE INVENTION

The present invention relates to an improved method and apparatus for cleaning the band of a line printer and the like and, more particularly, to an automated print band cleaner apparatus and method to effect rapid cleaning of inked bands which result in timing faults and t minimize printer and related equipment downtime.

BACKGROUND OF THE INVENTION

Previously, when a printer went down due to print band timing fault resulting from the timing notches being clogged with ink residue from the associated ink ribbon, the print band was removed and cleaned free of all print ribbon lint and ink residue. The same method is still in use today when this timing fault appears. A maintenance technician manually cleans the print band over a can or the like using a brush and liquid cleaner. This approach makes a mess and causes excessive hazardous waste. The time consumed in this cleaning method is approximately forty-five minutes. Furthermore, an associated piece of test system sits idle awaiting the replacement of the printer band.

SUMMARY OF THE INVENTION

It is an object of the present invention to provide a print band cleaner and method such that the total downtime for complete repair of the printer is approximately five minutes, with nominal hazardous waste and no mess.

The foregoing object has been achieved in accordance with the present invention by providing a printing band cleaning apparatus and method which is automatic and takes place within a self-contained or sealed container.

According to one currently preferred embodiment of the present invention, a commercially available cleaning solution such as acetone or alcohol can be provided in a sealed container which has a driver pulley driven by an AC motor and a spring-loaded driven pulley. The axes of rotation of the pulleys are arranged along a vertical or a horizontal plane. A dirty, lint covered print band is loaded about the pulleys for cleaning by opening a door, which can be transparent to observe the cleaning process, of the container and pulling back the spring-loaded driven pulley with a lever against the bias of a spring so that the band can be placed around both the driving and driven pulleys. Also, in this way, it is possible to accommodate more than one size of print band.

During the loading operation, the print band is also inserted between a rotatable brush and a spring loaded pressure plate which is locked back during the loading operation and thereafter allowed to press the moving band against the brush which is cause to rotate against the rectilinearly moving band to assure thorough cleaning of the band. The band is further moved between two air nozzles located downstream of the brush station, as viewed in the direction of travel of the band, to assure complete drying of the band after it has passed through the cleaning solution and the brush station

BRIEF DESCRIPTION OF THE DRAWINGS

These and further objects, features and advantages of the present invention will become more apparent from the following detailed description of currently preferred or contemplated embodiments when taken in conjunction with the accompanying drawings wherein.

DETAILED DESCRIPTION

Figure 1:
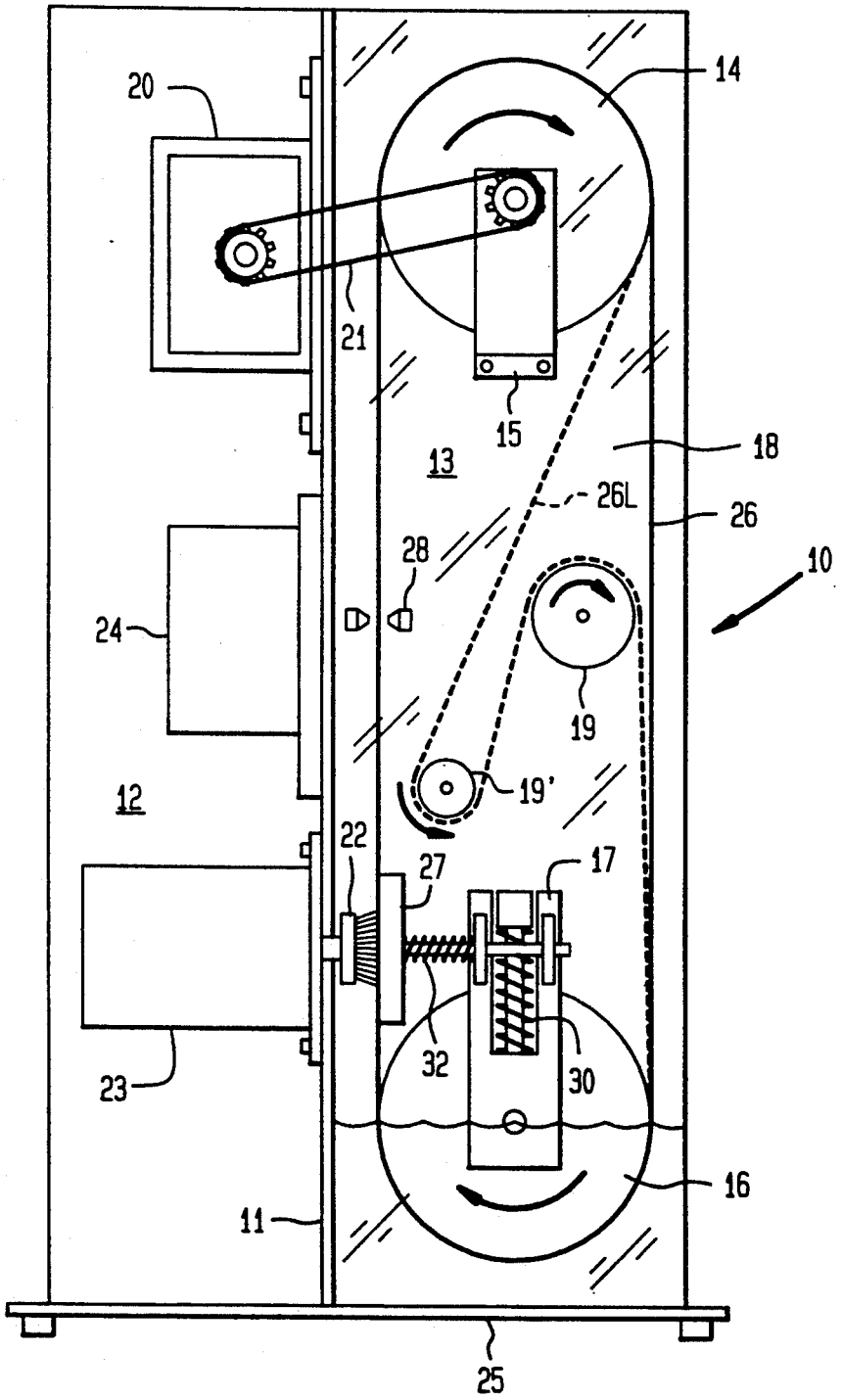
FIG. 1 is a schematic elevational view of one embodiment of the print band cleaning apparatus in a vertical orientation in accordance with the present invention.

Referring now to the drawings and, in particular to FIG. 1, there is shown a self-contained housing or container designated generally by the numeral 10, having a vertical wall 11 which defines a first compartment 12 for holding power supply devices hereinafter described and a fluid-tight second compartment 13 in which are arranged a drive pulley 14 rotatably mounted on a bracket 15 which is fastened to a wall of the container 10, and a driven pulley 16 rotatably mounted on a bracket 17 which is also fastened in the container 10. Housing 10 is provided with a transparent door 18 and includes vent areas (not shown) at the top for allowing the interior of the space 13 to breathe.

An AC, low rpm motor 20 is mounted to the vertical wall 11 in the first compartment and can be, for example, a 6 rpm motor. The output shaft of the motor is connected to the drive pulley 14 in a known manner via a belt or chain 21. To accommodate a longer print band, shown in broken lines 26L, a pair of free spooling, idler pulleys 19 and 19' may be mounted within the housing 10 between drive pulley 14 and driven pulley 16. A brush 22 is mounted for high speed rotation on the wall 11 in the second compartment 13 in an area adjacent to the driven pulley 16. A brush motor 23 is mounted on the wall 11 in the first compartment 12 and is connected with the brush 22 so as to rotate the latter at, for example, 15,000 rpm upon actuation of the cleaning apparatus. The brush motor 23 can be powered by, for example, a 15 volt DC power supply unit 24 mounted on the wall 11 on the first compartment 12.

A bottom portion 25 of the compartment 13 is adapted to receive a quantity of conventional print band cleaning solution, such as acetone or alcohol, to a level which covers at least a portion of the lower circumferential segment, as seen in FIG. 1, of the driven pulley 16. In FIG. 1, a print band to be cleaned is designated by the numeral 26 and is shown in the already-installed position over the pulleys 14, 16. To assure positive contact between the band 26 and the brush 22, a spring-loaded pressure plate 27 is mounted (for example, also on the bracket 17) in the second compartment 13 opposite the brush 22 so that the band 26, when installed, passes between the brush 22 and the pressure plate 27, with the characters on the print band 26 facing the brush 22, the bristles of which can thus thoroughly clean the interstices of the characters which have passed through the solution at the bottom portion 15. To assure that the solution left in the interstices in the characters of the band 26 has been dried, air can be supplied through nozzles or the like 28 located downstream of the brush 22 as viewed in the direction of movement of the band 26 indicated by the arrow A. In the illustrated embodiment of FIG. 1, the pulleys 14, 16 are rotating clockwise.

The pressure plate 27 is normally urged toward the brush 22 by a spring 32 in a known manner and is otherwise in the path of movement A of the band 26 before installation of the latter. When the band 26 is installed on the pulleys 14, 16 (or also around pulleys 19, 19'), plate 27 is pushed backward (to the right as seen in FIG. 1) to a locking position and thereafter allowed to return to its normal position so that a positive contact takes place between the characters on the print band 26 and the brush 22. Although not illustrated, the pressure plate 27 can be pulled back against the bias of the spring 32 and the driven pulley can be pulled back against the bias of a spring 30 during installation of the band 26 separately or by a single lever to a locking position in a manner well known and thus not illustrated.

Figure 2:
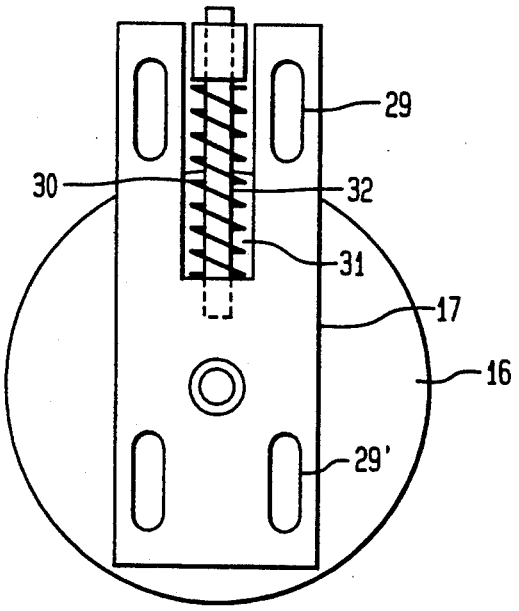
FIG. 2 is an isolated, enlarged view of the spring-loaded driven pulley shown in FIG. 1.

The bracket 17 for holding the driven pulley 16, but without the pressure plate mounting, is shown more clearly in FIG. 2. In addition to elongated mounting holes 29, 29' at the top and bottom of the bracket 17 to allow translation of the latter during band installations, a compression spring 30 is received within a bore or channel 31 and concentrically mounted around a support rod so as to normally urge driven pulley 16 downwardly as seen in FIG. 1. The support rod 32 is sized and arranged so that the bracket 17 can move vertically as the spring is compressed or relaxed toward its normal bias position. When the band 26 is installed, the pulley 16 is pushed against the bias of spring 30, as previously noted, and the print band 26 is slipped over a segment of the outer circumference of the pulleys 14, 16. Thereafter, the force acting against the pulley 16 and the bias of spring 30 is relaxed to allow the pulley 16 to assume its normal position with the band 26 now tensioned sufficiently to be driven by the driver pulley 14 when the motor 20 is actuated by a conventional switch (not shown) which can also activate the brush motor power supply 24.

To utilize the cleaning apparatus, the operator opens the door 18 and checks t see if there is a sufficient amount of the cleaning solution in the bottom 25 of the container compartment 13. The pressure plate 27 is then pushed backed against the bias of spring 32 and locked to allow installation of the dirty print band 26 with the character side of the band facing toward the brush 22. The pulley 16 is pushed upwardly, either simultaneously or in a separate operation by a lever, so that the band 26 can be loaded simultaneously on the pulleys 14, 16. After checking to make sure that the print band 26 is loaded properly, the door 18 is closed and the motor 20 is actuated to drive the pulley 14. After several minutes of operation, e.g., four minutes, air is supplied through the nozzles 28 for about 1 minute to remove excess solution from the band 26, particularly in the interstices of the characters.

Figure 3:
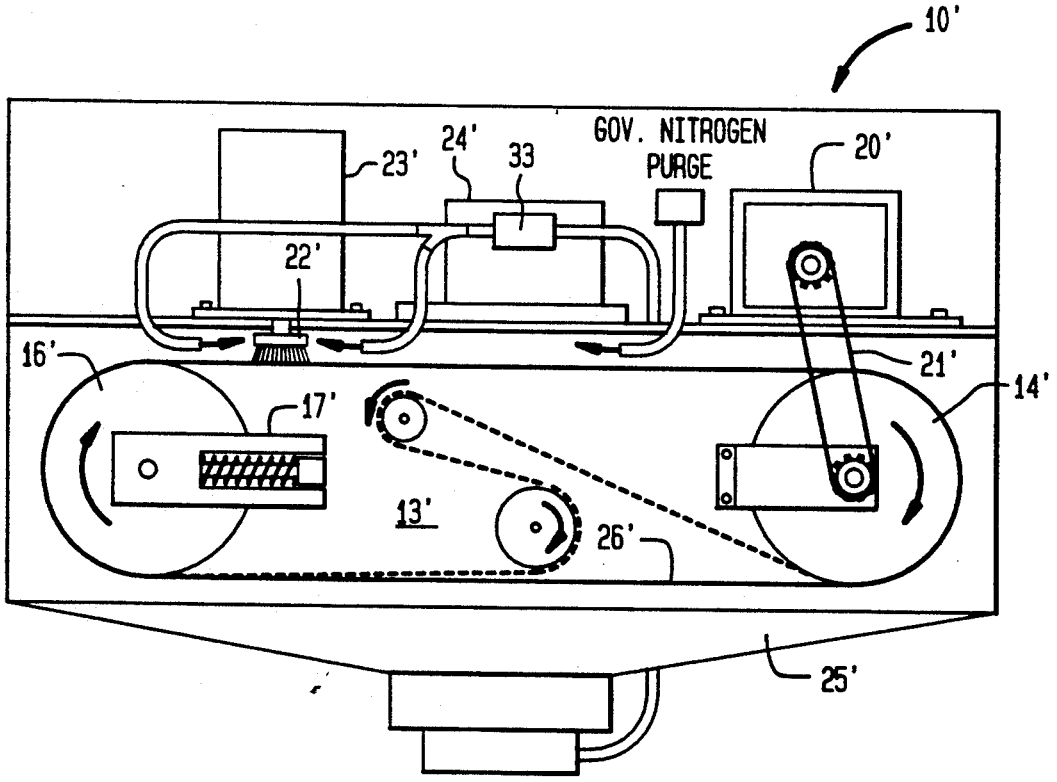
FIG. 3 is a schematic elevational view of another embodiment of the present invention in which the pulley are horizontally disposed.

Although the embodiment of FIG. 1 has the pulleys 14, 16 arranged vertically, the embodiment of FIG. 3 shows the pulleys 14', 16' horizontally disposed in a container 10'. The pressure plate has been dispensed with here but a pump 3 is provided to purge cleaning solution vapors which accumulate at the top of the chamber 13'. In all other respects, however, the principle of operation of this embodiment is the same as that of FIG. 1, and the similar parts are designated by the same numerals but primed.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A cleaning apparatus for a print band, comprising a container sized to receive at least one size of print band in the form of a continuous loop and a print band cleaning solution in a bottom portion thereof, a driver pulley operatively arranged at one end of the container, a driven pulley arranged at said bottom portion of the container, so as to be at least partially covered by said print band cleaning solution said driver pulley and driven pulley configured to be engaged by the print band during a cleaning operation, a brush rotatably mounted in the container and arranged to contact a face of the print band, and a pressure plate arranged opposite the brush so as to engage an opposed face of the print band.

2. The cleaning apparatus according to claim 1, wherein the driver pulley and the driven pulley are arranged vertically within the container.

3. The cleaning apparatus according to claim 1, wherein the driver pulley and the driven pulley are arranged horizontally within the container.

4. The cleaning apparatus according to claim 1, wherein the driven pulley is operatively mounted in the container, so as to be selectively movable with respect to the driver pulley.

5. The cleaning apparatus according to claim 1, wherein the pressure plate is mounted so as to be biased toward the brush.

6. The cleaning apparatus according to claim 5, wherein the driven pulley is operatively mounted in the container, so as to be selectively movable with respect to the driver pulley.

7. The cleaning apparatus according to claim 6, wherein the driver pulley and the driven pulley are arranged vertically within the container.

8. The cleaning apparatus according to claim 1, wherein means for drying the cleaning solution from the print band is arranged downstream of the brush as viewed in a travel direction of the print band.

9. The cleaning apparatus according to claim 1, wherein the driven pulley is operatively mounted so a to be normally biased away from the driver pulley during operation of the apparatus.

10. The cleaning apparatus according to claim 9, wherein the driven pulley is operatively mounted in the container, so as to be selectively movable with respect to the driver pulley.

11. The cleaning apparatus according to claim 10, wherein the pressure plate is mounted so as to be biased toward the brush.

12. The cleaning apparatus according to claim 11, wherein means for drying the cleaning solution from the print band is arranged downstream of the brush as viewed in a travel direction of the print band.

13. The cleaning apparatus according to claim 12, wherein the driver pulley and the driven pulley are arranged vertically within the container.

14. A method for rapidly cleaning a print band in a self-contained housing, comprising the steps of providing a cleaning solution mounting the print band about a driver and a driven member and between a rotatable brush and pressure plate, actuating the driver to move the print band through a cleaning solution at a bottom portion of the housing, mounting the driven member so that at least a lower circumferential portion is submerged in the cleaning solution and cleaning the print band by rotating the brush with the print band held in contact therewith by the pressure plate.

15. The method according to claim 14, wherein the step of mounting includes moving the driver and the driven member toward each other and moving the pressure plate away from the brush.

16. The method according to claim 15, wherein the step of mounting includes looping the print band which is in the form of a continuous loop around the driver configured as a motor driven pulley and around the driven member configured as a pulley after the pulleys have been moved toward each other.

17. The method according to claim 14, wherein the step of cleaning includes drying the print band by directing forced air against the print band at a location downstream of said brush after it has passed through the cleaning solution and the rotating brush at least one time.

18. An apparatus for cleaning printing ink ribbon residue from timing notches and interstices among characters of a continuous loop print band, said apparatus comprising a housing sized to receive said print band, said housing having a bottom portion that is sealable with respect to the passage of fluid therethrough, said bottom portion being arranged to receive and retain print band cleaning solution though which said print band may pass, a driver pulley operatively arranged at a first, upper portion of said housing and a driven pulley arranged at a second, lower portion of said housing, such that cleaning solution in said bottom portion of said housing covers at least a lower circumferential portion of said driven pulley, said driver pulley and said driven pulley being configured to be engaged by said print band during a cleaning operation, a brush rotatably mounted at a location in said housing that is adjacent to said bottom portion of said housing, said brush being arranged to contact a face of said print band as said print band emerges from said cleaning solution, a pressure plate arranged opposite to said brush so as to engage an opposed face of said print band, and a pair of forced air elements arranged adjacent to opposite faces of said print band, downstream of said brush as viewed in a travel direction of said print band, said pair of forced air elements positioned to direct forced drying air against opposite faces of said print band after said print band has passed through said cleaning solution and been subjected to rotational cleaning action of said brush thereagainst.

* * * * *